US005662858A

United States Patent [19]

Firgo et al.

[11] Patent Number: 5,662,858

[45] Date of Patent: Sep. 2, 1997

[54] PROCESS FOR THE PRODUCTION OF CELLULOSE FIBRES HAVING A REDUCED TENDENCY TO FIBRILLATION

[75] Inventors: Heinrich Firgo, Vöcklabruck; Markus Eibl, Lambach; Johann Schickermüller, Vöcklamarkt, all of Austria

[73] Assignee: Lenzing Aktiengesellschaft, Austria

[21] Appl. No.: 495,890

[22] Filed: Jun. 28, 1995

Related U.S. Application Data

[63] Continuation-in-part of Ser. No. 223,578, Apr. 6, 1994, abandoned.

[30] Foreign Application Priority Data

Apr. 28, 1993 [AT] Austria ..... 787/93

[51] Int. Cl.[6] ..... D01D 10/02; D01D 10/06; D01F 2/02

[52] U.S. Cl. ..... 264/474; 8/189; 8/190; 8/549; 264/187; 264/211.14; 264/211.17; 264/233

[58] Field of Search ..... 264/187, 203, 264/211.14, 211.17, 233, 474; 8/189, 190, 549

[56] References Cited

U.S. PATENT DOCUMENTS

| | | | |
|---|---|---|---|
| 2,394,306 | 2/1946 | Hentrich et al. . | |
| 3,383,443 | 5/1968 | Leahy et al. . | |
| 3,527,807 | 9/1970 | Tesoro et al. . | |
| 3,761,473 | 9/1973 | Tesoro et al. . | |
| 3,883,523 | 5/1975 | Parton . | |
| 4,246,221 | 1/1981 | McCorsley, III | 264/203 |
| 4,416,698 | 11/1983 | McCorsley, III . | |
| 4,563,189 | 1/1986 | Lewis . | |
| 5,094,690 | 3/1992 | Zikeli et al. | 106/198 |
| 5,310,424 | 5/1994 | Taylor | 8/190 |
| 5,330,567 | 7/1994 | Zikeli et al. | 106/198 |

FOREIGN PATENT DOCUMENTS

| | | |
|---|---|---|
| 174794 | 3/1986 | European Pat. Off. . |
| 356419 | 2/1990 | European Pat. Off. . |
| 538977 | 4/1993 | European Pat. Off. . |
| 2273091 | 12/1975 | France . |
| 1669384 | 12/1970 | Germany . |
| 402806 | 5/1966 | Switzerland . |
| 878655 | 10/1961 | United Kingdom . |
| 950073 | 2/1964 | United Kingdom . |
| WO92-07124 | 4/1992 | WIPO . |
| WO92-19807 | 11/1992 | WIPO . |

OTHER PUBLICATIONS

Dubé, M. et al., "Precipitation and Crystallization of Cellulose From Amine–Oxide Solutions," *1983 International Dissolving and Specialty Pulps*, pp. 111–119.

Brochure of Courtaulds Fibres, Nov. 88, Tenceleur 1–11.

Abstract of Japanese Patent Appln. Ser. No. 88/56,321 from *Chemical Abstracts*, vol. 112, 1990, p. 160411.

BASF brochure, "Ratgeber, Textilausrüstung," pp. 23, 27–33, and 96 (Undated).

*Handbuch der Textilhilfsmittel*, Herausgegeben von August Chwala und Vinzenz Anger in Zusummenarbeit mit Christl Chwala, 1977; pp. 95, 442–64; 474–5; 488–92.

*Textile Resins*, vol. 16, pp. 682–710 (Undated).

Prospectus of Enka AG, "Newcell® Technology"; p. 7 (Undated).

Betrabet, S. M. et al., "Behaviour of Bifunctional and Polyfunctional Reactive Dyes Applied to Cotton Cellulose," JSDC Sep., 1977, pp. 338–345.

Hemmpel, W–H et al., VTCC–Seminare, Apr., 1994, "Der Einsatz von Cellulasen zur Erzielung . . . Cellulosefasern", pp. 1–31, etc.

*Encyclopedia of Polymer Science and Technology*, vol. 11, Polyesterts to Rayons, pp. 814–815 (Undated).

Lenz, J. et al., Paper entitled "The Fibrillar Structure of Cellulosic Man–Made Fibers Spun from Different Solvent Systems;" Journal of Applied Polymer Science, vol. 35, 1988, pp. 1987–2000.

Uchida, Y., "Problems of Polynosic and Hgh Wet Modulus Fibres," pp. 461–474 (Undated).

Davies, S. "Courtaulds Tencel: A New Fibre for the Mass Market;" *Textile Outlook International*, Nov., 1992, pp. 8–18.

Tesoro et al., "Reactions of Cellulose with Unsymmetrical Sulfones," *Textile Research Journal*, Feb. 1963, pp. 93–107.

Rollins et al., "Abrasion Phenomena in Durable–Press Cotton Fabrics," *Textile Research Journal*, Oct. 1970, pp. 903–916.

Raheel et al., "The Use of Scanning Electron Microscopy for Studying Abrasion Phenomena in Laundered Fabric," vol. 17, No. 5, May 1985, pp. 101/23 to 26/104.

Achwal, W. B., "Contributions to Colouration of Textiles," *Colourage*, Apr. 22, 1982, pp. 3–13.

Lambert, A. et al., "Wet Fixation of Polymer Formers in Cotton," vol. 18, No. 1, Jan. 1986, pp. 39–43.

Rowland, S. "The Mechanism of Durable Press," vol. 4, No. 8, Aug. 1972, pp. 204/33 to 40/211.

Lenz, J. et al., "Comparative characterization of solvent spun cellulose and high wet modulus viscose fibres by their long periods," *Acta Polymer.*, 43.307–312 (1992).

Dolmetsch, H. et al., "Die Beeinflussing der . . . den Elementarfibrillen," *Melliand Textilberichte*, May 1967, pp. 561–570.

(List continued on next page.)

*Primary Examiner*—Leo B. Tentoni

*Attorney, Agent, or Firm*—Brumbaugh, Graves, Donohue & Raymond

[57] ABSTRACT

Process for the production of cellulose fibres having a reduced tendency to fibrillation, in which a solution of cellulose in a tertiary amine-oxide is spun into fibres and the freshly spun fibres are contacted with a textile agent comprising at least two reactive groups, and are heat-treated, characterized in that the heat treatment is carried out by means of irradiation with electromagnetic waves.

6 Claims, No Drawings

OTHER PUBLICATIONS

Bredereck, K. et al., "Die Beeinflussung der . . . den Elementarfibrillen," *Melliand Textilberichte,* Jun. 1967, pp. 699–707.

Lenz, J. et al., article, 42. Jahrgang, Heft 12, 1988, pp. 683–689 etc.

Kunschner, A., Journal article "Querschnitts– und . . . und Baumwolle," *Chemiefasern* 8–67, pp. 596–601 (Undated).

Kunschner, A., Journal article "Querschnitts– und . . . Fasern und Baumwolle (V)," *Chemiefasern* 1–68, pp. 54–60 (Undated).

Kunschner, A., Journal article "Querschnitts– und . . . Fasern und Baumwolle (IV)," *Chemiefasern* 12–67, pp. 1002, 1004–1009 (Undated).

Prett, K., "Uber die Bedeutung der . . . von Cellulosefasern," *Melliand Textilberichte,* Jan. 1969, pp. 81–84.

Krässig, V. "Mechanismus der Entwicklung . . . Cellulosefasern," *Chimia* 22, May 1968, pp. 234–238.

Partial English language translation of FR 2,273,091 (Dec. 1975).

Walsh, F., "Survey of Exhaust Dyeing with Remayol Dyes", *International Dyes & Textile Printer,* pp., Mar. 4, 1977, pp. 232–237.

Haggag, K., "Fixation of Pad–Dyeings On Cotton Using Microwave Heating", *American Dyestuff Reporter,* Aug. 1990, pp. 26–30.

PROCESS FOR THE PRODUCTION OF CELLULOSE FIBRES HAVING A REDUCED TENDENCY TO FIBRILLATION

This application is a continuation-in-part of U.S. Ser. No. 08/223,578 filed Apr. 6, 1994, now abandoned, which is incorporated by reference herein.

BACKGROUND OF THE INVENTION

The invention is concerned with a process for the production of cellulose fibres having a reduced tendency to fibrillation.

As an alternative to the viscose process, in recent years there has been described a number of processes in which cellulose, without forming a derivative, is dissolved in an organic solvent, a combination of an organic solvent and an inorganic salt, or in aqueous saline solutions. Cellulose fibres made from such solutions have received by BISFA (The International Bureau for the Standardization of man made Fibres) the generic name Lyocell. As Lyocell, BISFA defines a cellulose fibre obtained by a spinning process from an organic solvent. By "organic solvent", BISFA understands a mixture of an organic chemical and water. "Solvent-spinning" is considered to mean dissolving and spinning without the forming of a derivative.

So far, however, only one process for the production of a cellulose fibre of the Lyocell type has achieved industrial-scale realization. In this process, a tertiary amine-oxide, particularly N-methylmorpholine-N-oxide (NMMO), is used as a solvent. Such a process is described for instance in U.S. Pat. No. 4,246,221 and provides fibres which present a high tensile strength, a high wet-modulus and a high loop strength.

However, the usefulness of plane fibre assemblies, for example fabrics, made from the above fibres, is significantly restricted by the pronounced tendency of such fibres to fibrillate when wet. Fibrillation means the breaking up of the wet fibre in longitudinal direction at mechanical stress in a wet condition, so that the fibre gets hairy, furry. A fabric made from these fibres and dyed significantly looses color intensity as it is washed several times. Additionally, light stripes are formed at the abrasion and crease edges. The reason may be that the fibres consist of fibrils which are arranged in the longitudinal direction of the fibre axis and that the crosslinking between these fibres is reduced.

WO 92/14871 describes a process for the production of a fibre having a reduced tendency to fibrillation. The reduced tendency to fibrillation is attained by providing all the baths with which the freshly spun fibre is contacted before the first drying with a maximum pH of 8.5.

WO 92/07124 also describes a process for the production of a fibre having a reduced tendency to fibrillation, according to which the freshly spun, i.e. not yet dried, fibre is treated with a cationic polymer. As such a polymer, a polymer with imidazole and azetidine groups is mentioned. Additionally, there may be carried out a treatment with an emulsifiable polymer, such as polyethylene or polyvinylacetate, or a crosslinking with glyoxal.

In a lecture given by S. Mortimer at the CELLUCON conference in 1993 in Lund, Sweden, it was mentioned that the tendency to fibrillation rises as drawing is increased.

It is the objective of the invention to provide a process which can be carried out in an easy way, allowing the production of cellulose fibres of the Lyocell type having a reduced tendency to fibrillation.

The process according to the invention for the production of cellulose fibres having a reduced tendency to fibrillation consists in that the freshly spun, not yet dried fibres are contacted with a textile agent, which carries at least two reactive groups, and are washed with an aqueous buffer, provided glyoxal is not used as textile agent.

As textile agents, especially dyes having two reactive groups have shown good results. According to the invention, however, textile agents which are colorless, i.e. do not absorb visible light, may also be used.

According to the invention, the use of textile agents which carry at least one vinylsulfone group as reactive groups is preferred.

A convenient embodiment of the process according to the invention is characterized in that the freshly spun fibres are contacted with the textile agent in an aqueous alkaline medium.

It was shown that the tendency to fibrillation is especially reduced when an alkali carbonate and an alkali hydroxide is chosen as the alkaline medium.

Another preferred embodiment of the process according to the invention consists in that the fibres contacted with the textile agent are heat-treated. The heat treatment drastically reduces the impregnation time.

EP-A -0 538 977, published on Apr. 28, 1993, describes heat treatment of cellulose fibres impregnated with a dye. It was shown, however, that heating of the fibres impregnated with the textile agent by means of hot air may reduce the impregnation time, but that this carries the risk of the fibres not being heated uniformly. Thus for example, the fibres on the outside of a fibre bundle to be dried may already be partly dried, while the fibres inside the bundle have not yet reached the required temperature. This has a negative effect on the quality of the fibres produced.

It has been found that this drawback occurring in a simple heat treatment can be overcome by irradiating the fibres with electromagnetic waves, particularly microwaves. When irradiated with microwaves, on the one hand the fibres are heated uniformly and on the other hand premature drying of the fibres can be avoided. Since irradiation with electromagnetic waves provides the possibility to weld the fibre bundle for example into a plastic wrapping and expose it in a welded condition to the electromagnetic field.

The above advantages are also given when the fibres, for example lying as plane fibre assembly on a conveyor, are moved through a narrow channel, in which they are exposed to electromagnetic waves. This channel can be designed in a way that only little air space above the fibres is left, thereby preventing a partial drying of the outer fibres of the bundle. Simultaneously, this way of fixation of the textile agent also offers the possibility of a large-scale production easy to put into practice.

Thus, the invention further refers to a process for the production of cellulose fibres having a reduced tendency to fibrillation, in which a solution of cellulose in a tertiary amine-oxide is spun into fibres and the freshly spun fibres are contacted with a textile agent which carries at least two reactive groups and are heat-treated, characterized in that the heat treatment is carried out by irradiation with electromagnetic waves.

Also according to this embodiment of the process according to the invention, the use of a textile agent which carries vinylsulfone groups as the reactive groups, is preferred, preferably being a dye. However, textile agents which are colorless, i.e. do not absorb visible light, can also be used.

Another preferred embodiment of the process according to the invention consists in carrying out the heat treatment by means of microwaves.

The invention will be explained in more detail by the following examples. All references to % are to be understood as weight %.

PRODUCTION OF THE CELLULOSE FIBRES

According to the process described in EP-A-0 356 419, a solution of cellulose in NMMO was prepared and extruded through a spinneret. The filaments thereby obtained were conducted through an air gap into an aqueous precipitation bath, in which the cellulose coagulated. The fibres obtained in the precipitation bath were washed, presenting a titer of 1.7 dtex. The washed fibres were used for the examples hereinafter described and represent those fibres which in the present description and in the present claims are referred to as fibres freshly spun, not yet dried.

1. Treatment with textile agents without subsequent heat treatment

A) General procedure 1 g of each of the fibres produced according to the above process were impregnated in 190 ml of an aqueous solution (bath), which contained a textile agent comprising two reactive groups and $Na_2SO_4$, at 40° C. for 30 minutes. Then NaOH (3%), $Na_2CO_3$ (4%) or a mixture of NaOH, $Na_2CO_3$ (4% $Na_2CO_3$ and 0.2 g/1 NaOH) were added for the fixation of the textile agent. After another 60 minutes at 40° C. the fibres were washed several times, in order to remove the textile agent not fixed to the fibre. Then the washed fibres were treated for 30 minutes with an aqueous buffer, then again washed with water (for 15 minutes) and dried at 60° C. Afterwards the fibres were examined to determine their tendency to fibrillation and to determine other fibre parameters.

Evaluation of fibrillation

The abrasion of the fibres among each other in washing processes and finishing processes in wet condition was simulated by the following test: 8 fibres with a length of 20 mm each were put into a 20 ml sample bottle with 4 ml of water and shaken during 9 hours in a laboratory mechanical shaker of the RO-10 type of the company Gerhardt, Bonn (Germany), at stage 12. Afterwards the fibrillation behavior of the fibres was evaluated by microscope, by means of counting the number of fibrils per 0.276 mm fibre length.

Further fibre parameters

The fibre tensile strength and fibre elongation at break were tested following the BISFA rule on "Internationally agreed methods for testing viscose, modal, cupro, lyocell, acetat and triacetat staple fibres and tows", edition 1993.

B) Examples

According to the above process, fibres were treated with the dye Remazol Black B and Remazol Red RB as textile agent available from Hoechst AG. The dye Remazol Black B includes two vinylsulfone groups and the dye Remazol Red B includes one vinylsulfone group and one monochlorotriazine group.

The bath contained 3% Remazol Black B and 0.5% Remazol Red RB respectively. The used aqueous buffer was an aqueous solution which contained 3% acetic acid and sodium acetate. The pH of this solution was 4.6. After the treatment with the buffer, the fibres were washed with water for 15 minutes and afterwards examined. Table 1A indicates the fixing agent used in each case, the fibrillation (number of fibrils), the titer (dtex), the fibre strength (cN/tex) and the fibre elongation at break (%). Examples 1, 2 and 3 were carried out with the dye Remazol Black B and Example 4 with the dye Remazol Red RB.

Table 1B shows the results of comparative tests carried out without dye.

TABLE 1A (TEXTILE AGENT)

| Ex. | Fixing Agent | Fibrils | Titer | Tensile Strength | Elongation |
|---|---|---|---|---|---|
| 1 | NaOH | 22 | 1.82 | 28.81 | 11.14 |
| 2 | $Na_2CO_3$ | 2 | 2.07 | 26.39 | 10.67 |
| 3 | NaOH + $Na_2CO_3$ | 0 | 2.34 | 24.94 | 10.04 |
| 4 | NaOH + $Na_2CO_3$ | 5 | 2.34 | 30.00 | 11.74 |

TABLE 1B (COMPARATIVE EXAMPLES)

| Ex. | Fixing Agent | Fibrils | Titer | Tensile Strength | Elongation |
|---|---|---|---|---|---|
| 5 | NaOH | >60 | 1.80 | 33.76 | 12.71 |
| 6 | $Na_2CO_3$ | 60 | 1.56 | 33.78 | 12.15 |
| 7 | NaOH + $Na_2CO_3$ | >60 | 1.72 | 30.18 | 12.14 |
| 8 | NaOH + $Na_2CO_3$ | >60 | 1.72 | 32.00 | 12.70 |

A comparison of the results of Tables 1a and 1b shows that the textile agent, in the present case the dyes Remazol Black B and Remazol Red RB, drastically reduces the tendency to fibrillation and that the combination of NaOH+$Na_2CO_3$, which is used for the fixation of the textile agent, also drastically further reduces the tendency to fibrillation. The effect of the combination of NaOH and $Na_2CO_3$ on fibrillation is further illustrated hereinbelow.

It was shown that the above results are obtained also when using other textile agents which comprise two reactive groups. Thus, Remazol Black B and Remazol Red RB may represent other textile agents which also carry at least two reactive groups.

2. Treatment with textile agents in alkaline medium containing a mixture of NaOH and $Na_2CO_3$ 1 g of each of the fibers produced according to the above process were impregnated in 30 ml of an aqueous bath which contained the dye Remazol Black B available from Hoechst AG as textile agent, 50 g/l $Na_2SO_4$ and varying amounts of $Na_2CO_3$ and/or NaOH as fixing agent for 3 minutes at 40° C. The dye was used in an amount of 21% by weight of fiber. The fibers were pressed to a moisture content of approximately 180% and heated to 160° C. for 90 seconds for condensation.

Afterwards the fibers were washed for 10 minutes with cold water, then 10 minutes with hot water. The fibers were then neutralized with diluted acid for 5 minutes and again washed for 5 minutes with cold water. Finally, the fibers were dried at 60° C.

Table 2 summarizes the amounts of $Na_2CO_3$ and NaOH used as fixing agent during the treatment of fibers.

TABLE 2

| Example | Remazol Black B | $Na_2SO_4$ | $Na_2CO_3$ | NaOH |
|---|---|---|---|---|
| 9 | 214 of fibre | 50 g/l | 40 g/l | 0 |
| 10 | 21% of fibre | 50 g/l | 40 g/l | 1.5 g/l |
| 11 | 21% of fibre | 50 g/l | 0 | 1.5 g/l |
| 12 | 21% of fibre | 50 g/l | 40 g/l | 0.2 g/l |
| 13 | 21% of fibre | 50 g/l | 80 g/l | 0 |

TABLE 2-continued

| Example | Remazol Black B | $Na_2SO_4$ | $Na_2CO_3$ | NaOH |
|---|---|---|---|---|
| 14 | 21% of fibre | 50 g/l | 80 g/l | 0.2 g/l |
| 15 | 21% of fibre | 50 g/l | 0 | 10 g/l |

The fibers produced in Examples 9–15 tested for their abrasion resistance in the following manner. 20 fibers with a length of 40 mm were laid over a roll with a thickness of 1 cm and were loaded with a weight of 70 mg. The roll was covered with a textile made from viscose filament yarn and was wetted continuously. During the measurement the roll was rotated and at the same time moved perpendicularly to the fibre axis forwardly and backwardly. The distance of movement was approximately 1 cm.

The number of rotations were counted until the fibre was completely chafed through. The mean value of the abrasion cycles of the 20 fibers is reported below. This value for the abrasion resistance corresponds very closely to the tendency of the fibers to fibrillate when wet. The higher the value for the abrasion resistance, the lower is the tendency to fibrillation. The results are shown in Table 3. The results for an untreated control fiber are also shown in Table 3.

TABLE 3

| Example | Abrasion resistance (Rotations | Fibre tenacity (cN/tex) | Elongation at break (%) |
|---|---|---|---|
| Control | 68.96 | 36.5 | 11.8 |
| 9 | 98.29 | 32.6 | 10.8 |
| 10 | 92.2 | 33.3 | 11.1 |
| 11 | 68.26 | 35.2 | 13.4 |
| 12 | 79.91 | 34.7 | 12.7 |
| 13 | 279.16 | 33.5 | 12.3 |
| 14 | 469.05 | 33.2 | 12 |
| 15 | 379.26 | 33.2 | 12.2 |

3. Treatment with textile agents and Subsequent heat treatment 1 g of each of the fibres produced according to the above process was impregnated in 190 ml of a bath (containing 0.2% Remazol Black B, 2% $Na_2CO_3$, 0.2% NaOH, pH=11.5) three times for 30 seconds each, the fibres being squeezed off after each impregnation. Afterwards, each sample was heat-treated twice for 40 seconds in each case in a circulating-air oven at 180° C. Subsequently, each heat-treated sample was treated for 30 minutes with the above mentioned acetate buffer (pH=4.6), washed with water for minutes, dried at 60° C. and examined. The results are shown in Table 4, Example 17 representing a Control Sample (for Example 17, Example 16 was repeated without using a textile agent).

TABLE 4

| Ex. | Fibrils | Titer | Tensile Strength | Elongation |
|---|---|---|---|---|
| 16 | 24 | 1.56 | 33.78 | 12.15 |
| 17 | >57 | 1.80 | 33.76 | 12.71 |

From Table 4 it can be seen that a heat treatment of the fibres impregnated with the textile agent drastically reduces the impregnation time, as well as the tendency to fibrillation is reduced.

With the dye Remazol Red RB, similarly good results could be attained.

4. Treatment with textile agents and subsequent irradiation with microwaves 10 g of the fibres produced according to the above process were impregnated in a 900 ml bath (10% Remazol Black B, 10% $Na_2SO_4$, 8% $Na_2CO_3$; the pH was adjusted with NaOH to 11.5) for 9 minutes. Afterwards, the fibres were squeezed off and divided into 2 parts of equal amount (Examples 19, 20). Example 18 was a Control Sample, indicating the properties of the fibres not treated with a textile agent. For Examples 19 and 20, the fibres were squeezed off after impregnation with the bath, and they either were heated to 180° C. for 180 seconds (Example 19) or irradiated with 90 watt microwaves for 50 seconds (Example 20). Afterwards, the fibres were treated for 30 minutes in the above acetate buffer at a pH of 4.6, washed with water for 15 minutes and dried at 60° C. The results of the tests are shown in Table 5.

TABLE 5

| Ex. | Heating | Fibrils | Titer | Tensile Strength | Elongation |
|---|---|---|---|---|---|
| 18 | — | 56 | 1.83 | 31.98 | 11.52 |
| 19 | 180 sec.; 180° C. | 11 | 1.91 | 23.70 | 9.77 |
| 20 | 50 sec.; 90 W | 7 | 1.92 | 31.23 | 11.34 |

From Table 5 it can be seen that the irradiation with microwaves further reduces the heating time, the tendency to fibrillation being still further reduced. Similarly good results in terms of a reduced tendency to fibrillation were obtained, when instead of Remazol Black B other textile agents with at least two reactive groups were used. Particularly it was shown that the positive effect Upon the tendency to fibrillation is similarly pronounced as with glyoxal. Furthermore it was shown that the above positive effect brought about by irradiation with microwaves can also be observed with glyoxal and other dialdehydes, as can be deduced from the following example.

2 g of fibres produced according to the process described in section 1 were impregnated twice for 3 minutes each with 140 ml of a bath, containing 2% glyoxal and 0.66% crosslinking catalyst (for example Condensol FB, a mixture of $ZnCl_2$ and $MgCl_2$, made by BASF). Afterwards, the fibres were squeezed off and divided into 2 parts (Examples 22, 23). Example 21 was a Control Sample, for Example 22 the fibres were treated for 10 minutes in a circulating-air oven at 100° C., and for Example 23 the fibres were subjected to a power of 500 watt by means of a microwave. The fibrillation results are indicated in the following Table 6.

The above method was repeated, using glutardialdehyde (3.4%) instead of glyoxal. The fibrillation results of the obtained fibres are also reflected in Table 6 (Examples 24, 25 and 26 correspond to Examples 21, 22 and 23 respectively).

TABLE 6

| Example | Textile agent | Treatment | Fibrils |
|---|---|---|---|
| 21 | — | — | 35.5 |
| 22 | Glyoxal | 10 min.; 100° C. | 24.0 |
| 23 | Glyoxal | 60 sec.; 500 w | 8.5 |
| 24 | — | — | 35.5 |
| 25 | Glutardialdehyde | 10 min.; 100° C. | 10.5 |
| 26 | Glutardialdehyde | 60 sec.; 500 w | 21.0 |

We claim:

1. A process for the production of cellulose fibers having a reduced tendency to fibrillation comprising the steps of:

spinning a solution of cellulose in a tertiary amine oxide into fibers, and contacting the freshly spun fibers with a textile agent in an aqueous alkaline medium comprising alkali carbonate and alkali hydroxide, the textile agent having at least two reactive groups, thereby producing cellulose fibers having a reduced tendency to fibrillation.

2. A process according to claim 1, wherein the textile agent comprises a dye or a colorless substance.

3. A process according to claim 1 or 2, wherein the textile agent has at least one vinylsulfone group as reactive group.

4. A process according to claim 3, further comprising the step of heat-treating the fibers.

5. A process according to claim 4, wherein the heat treatment is carried out by means of microwaves.

6. A process according to claim 1, further comprising the step of washing the fibers with an aqueous buffer after said contacting step.

* * * * *

UNITED STATES PATENT AND TRADEMARK OFFICE

CERTIFICATE OF CORRECTION

PATENT NO. : 5,662,858

DATED : September 2, 1997

INVENTOR(S) : Firgo et al.

It is certified that error appears in the above-identified patent and that said Letters Patent is hereby corrected as shown below:

Col. 2, line 41, "avoided. Since" should read -- avoided, since --;

Col. 4, line 62, "214 of fibre" should read -- 21% of fibre --;

Col. 5, line 49, "minutes" should read -- 15 minutes --;

Col. 6, line 31, "Upon" should read -- upon --.

Signed and Sealed this

Second Day of December, 1997

*Attest:*

*Attesting Officer*

Bruce Lehman

BRUCE LEHMAN

*Commissioner of Patents and Trademarks*